US005397290A

United States Patent [19]

Hellenthal

[11] Patent Number: 5,397,290

[45] Date of Patent: Mar. 14, 1995

[54] ELECTRICALLY HEATED CALENDER ROLL

[75] Inventor: Ludwig Hellenthal, Kirchhundem, Germany

[73] Assignee: Walzen Irie GmbH, Netphen, Germany

[21] Appl. No.: 80,439

[22] Filed: Jun. 21, 1993

[30] Foreign Application Priority Data

Jun. 22, 1992 [DE] Germany ..... 42 20 395.3

[51] Int. Cl.[6] ..... B21B 31/08

[52] U.S. Cl. ..... 492/46; 492/9; 492/10

[58] Field of Search ..... 492/9, 10, 46; 162/375, 162/206; 34/110

[56] References Cited

U.S. PATENT DOCUMENTS

| | | | |
|---|---|---|---|
| 4,285,107 | 8/1998 | Küsters et al. | 492/46 |
| 4,348,819 | 9/1982 | Gamble | 492/46 |
| 4,614,565 | 9/1986 | Riihinen | 492/46 |
| 4,631,792 | 12/1986 | Wesemann et al. | 492/46 |
| 4,734,966 | 4/1988 | Zaoralek | 492/46 |
| 4,888,464 | 12/1989 | Shibata et al. | 492/46 |
| 5,153,660 | 10/1992 | Goto | 492/46 |
| 5,171,404 | 12/1992 | Ellis et al. | 492/46 |
| 5,177,552 | 1/1993 | Isogai et al. | 492/46 |

FOREIGN PATENT DOCUMENTS

| | | |
|---|---|---|
| 1343136 | 11/1962 | France . |
| 2750047 | 6/1978 | Germany . |
| 8410839 U | 7/1984 | Germany . |
| 8436564 U | 3/1985 | Germany . |
| 4016823 | 11/1991 | Germany . |
| 4033986 | 2/1992 | Germany . |

*Primary Examiner*—Irene Cuda

*Attorney, Agent, or Firm*—Herbert Dubno; Andrew Wilford

[57] ABSTRACT

A heated calender roll at a predetermined operating temperature has a roll body having a cylindrical outer surface centered on an axis and formed radially inward from the surface with at least one axially extending passage, a pair of hub elements axially flanking and joined to the roll body, and at least one electrical heating element in the passage. A mass of heat-conducting metal in the passage has an outer surface bonded to but distinct from the roll body and an inner surface bonded to but distinct from the heating element. The metal has a melting point in excess of the operating temperature of the roll. The calender roll can be formed with a plurality of such passages each receiving a respective such electrical heating element and a respective mass of the heat-conducting metal. Alternately it can be formed with a single such passage receiving a plurality of such electrical heating elements and the mass of the heat-conducting metal. The mass can be a pure metal or a metallic alloy chosen for high thermal conductivity.

9 Claims, 2 Drawing Sheets

ELECTRICALLY HEATED CALENDER ROLL

FIELD OF THE INVENTION

The present invention relates to a calender roll. More particularly this invention concerns such a roll which is electrically heated by internal electric heating elements.

BACKGROUND OF THE INVENTION

A heated calender roll is used in many industrial processes, for instance paper-making, plastic-sheet embossing, and panel production. It typically comprises a body having a cylindrical outer surface centered on a roll axis and a pair of axially spaced end or hub members in which the ends of the body are set. These hubs in turn are held in bearings or journals and are connected to drive belts or gears in the case of driven calender rolls.

In order to heat a calender roll it is standard as described in German utility models 8,410,839 and 8,436,564 and German patent document 2,750,047 to form the roll body with an array of flow passages and to provide means for pumping a heat exchange medium such as steam or hot oil through these passages. Since the medium must pass through the bearing or joint to move between the equipment heating the medium and the roll, such an assembly can get quite complex. The hot medium, frequently 100° C.–200° C., presents a danger for nearby workers if a supply hose ruptures and is generally difficult to conduct and manage.

It has therefore been suggested in French patent 1,343,136 to use a hollow-cylindrical roll body that is internally fitted with electrically powered heating elements of the resistive type. Heat is conducted by a liquid heat-exchange medium from the elements to the roll-body surface. Thus this liquid is wholly confined in the calender roll and does not need to pass through the rotating joint, considerably simplifying the equipment.

Since oil or water is not a truly efficient heat-exchange medium at the above-given temperatures, typically because there is some phase or composition change on heating, it has been suggested in German patent document 4,016,823 to use as the heat-exchange medium a liquid metal that melts at a temperature slightly below the operating temperature of the roller. This arrangement is particularly susceptible to leakage since most molten metals are very hard to contain.

Similarly German patent document 4,033,986 proposes using water in the roll in special chambers that move it convectively and that ensure its condensation and boiling under controlled circumstances. The problem with this arrangement is that it limits the temperature range for use of the roll, in particular setting a relatively low upper limit.

OBJECTS OF THE INVENTION

It is therefore an object of the present invention to provide an improved heated calender roll.

Another object is the provision of such an improved heated calender roll which overcomes the above-given disadvantages, that is which is electrically heated but that does not have the problems of the prior-art systems using a liquid as the heat-exchange medium between the electrical heating element or elements and the roller surface.

SUMMARY OF THE INVENTION

A heated calender roll adapted to be used at a predetermined operating temperature has according to the invention a roll body having a cylindrical outer surface centered on an axis and formed radially inward from the surface with at least one axially extending passage, a pair of hub elements axially flanking and joined to the roll body, and at least one electrical heating element in the passage. A mass of heat-conducting metal in the passage has an outer surface bonded to but distinct from the roll body and an inner surface bonded to but distinct from the heating element. The metal has a melting point in excess of the operating temperature of the roll.

Thus this metal conducts heat from the element to the roll while remaining solid. This greatly simplifies construction of the roll while still ensuring excellent heat transmission between the heating element and the roll.

The calender roll according to the invention can be formed with a plurality of such passages each receiving a respective such electrical heating element and a respective mass of the heat-conducting metal. Alternately it can be formed with a single such passage receiving a plurality of such electrical heating elements and the mass of the heat-conducting metal. The mass can be a pure metal or a metallic alloy chosen for high thermal conductivity. In any case the heating element has an outer surface of a metal and the roll is formed of a material having melting points above the melting point of the outer-surface metal.

In accordance with a further feature of the invention at least one temperature sensor is imbedded in the body between the element and the outer surface of the body. This temperature sensor is closer to the outer surface of the body than to the electrical heating element. It is possible for the heating element to be subdivided axially into a plurality of individually energizable portions and the roll to be provided with one such sensor level with each such portion.

The calender roll according to the invention can be made by filling a space between the element and the body with a powder of the metal. To ensure good conduction between the mass and the roll access of oxygen is blocked to an inner surface of the roll during filling of the space with the powder. This is most easily done by maintaining the surface in an atmosphere of a gas not including oxygen. Alternately the space is filled by pouring the metal in molten condition into the space.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
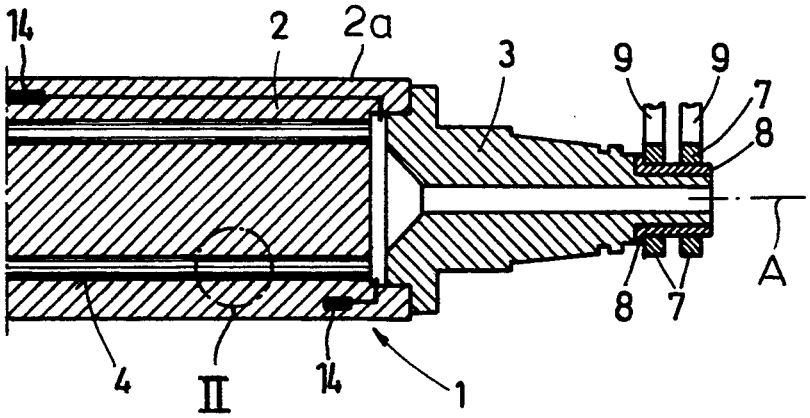
FIG. 1 is an axial section through an end of a calender roll according to the invention.

As seen in FIG. 1 a roller 1 according to the invention is basically centered on an axis A and has a massive metallic roller body 2 normally made of steel and having an outer surface 2*a*. Each end (only one shown) of the body 1 is screwed to a hub element 3 adapted to be supported in a bearing and having an insulating sleeve 8 on its end supporting a pair of commutator rings 7 engaged by respective brushes or wipers 9.

Figure 2:
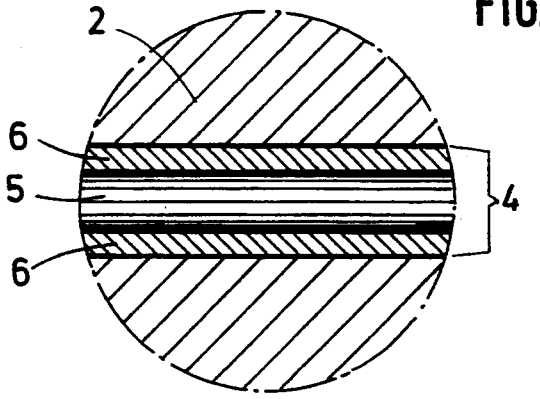
FIG. 2 is a large-scale sectional view of the detail indicated at II in FIG. 1.

According to the invention and as seen better in FIG. 2 the body 2 is formed with a plurality of angularly equispaced and axially throughgoing passages 4 of cylindrical shape each receiving a respective electrical resistive-type heater element 5. Normally these heaters 5 are powered via the rings 7 by alternating current, either two- or multiphase. The inner diameters of the passages 4 are much greater than the outer diameters of the heater elements 5 and the cylindrically annular space between them is completely filled with a metallic mass 6 whose outer surface is bonded to but distinct from the inner surface of the passage and whose inner surface is bonded to but distinct from the outer surface of the element 5. The metal of the mass 6 can be an alloy and has a melting point that is somewhat above the maximum operating temperature of the roll 1 so that this mass 6 remains in solid form during operation of the roll 1.

Figure 3:
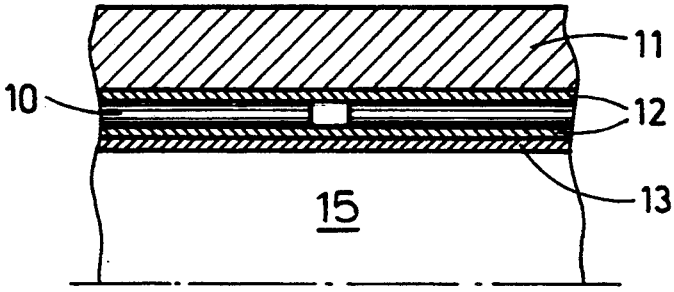
FIG. 3 is a sectional view of a detail of another roll according to the invention.

FIG. 3 shows a roll 11 which is basically tubular and formed with a single central passage 15 in which a plurality of heating elements 10 are mounted. Metal or metallic-alloy potting 12 secures these elements 10 in place and a liner tube 13 may be provided coaxially in the tubular roll 11 to form an inner mold wall for holding this potting 12 in place. The liner 13 can be dispensed with if centrifugal casting techniques are used to deposit the metal potting mass 12.

In FIG. 3 the element 10 is shown to be subdivided axially into several parts for more accurate control of individual heating zones. FIG. 1 also shows temperature sensors 14 imbedded in the roll 2 centrally and at the end between the heaters 5 and the outer surface 2*a* so as to monitor the heating zones.

Figure 4:
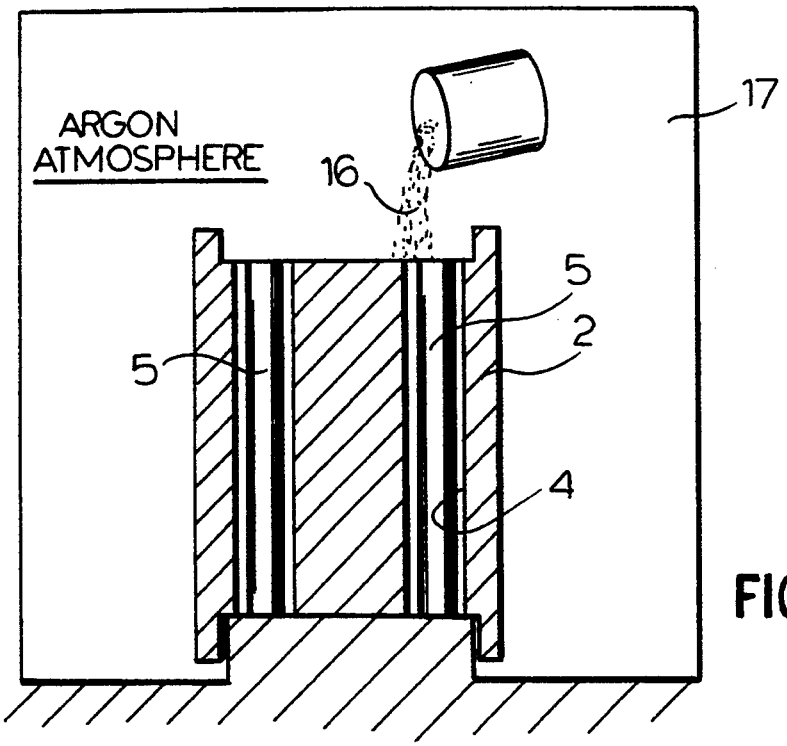
FIGS. 4 and 5 are largely schematic views illustrating methods of making the roll of this invention.

More particularly as shown in FIG. 4 the mass 6 can be formed by pouring a powder 16 into the space between the elements 5 and the inner surfaces of the passages 4. To prevent oxidation before this powder 16 is tamped in place this is done in a chamber 17 filled with an inert gas such as argon.

Figure 5:
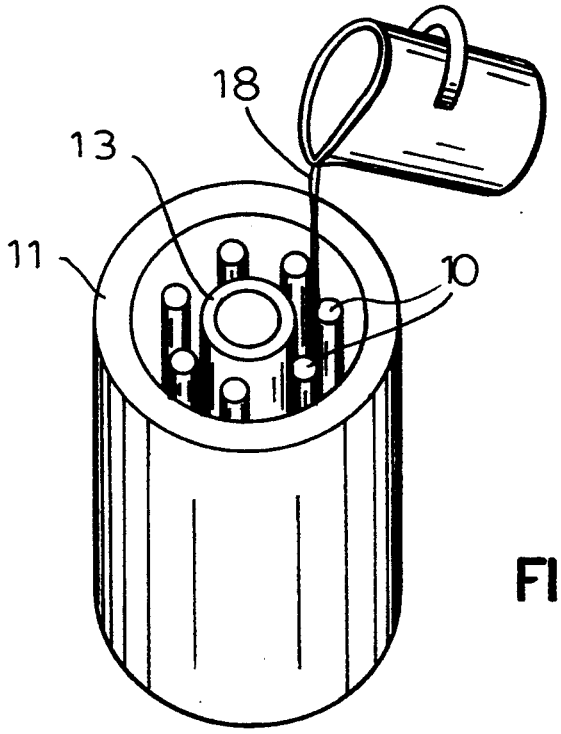

It is also possible as shown in FIG. 5 to pour molten metal 18 into the space between the liner tube 13 and the inner wall of the tubular roll 11 to pot the elements 10 into place.

I claim:

1. A heated calender roll adapted to be used at a predetermined operating temperature and comprising:

a roll body having a cylindrical outer surface centered on an axis and formed radially inward from the surface with at least one axially extending passage;

a pair of hub elements axially flanking and joined to the roll body;

at least one electrical heating element in the passage; and a mass of heat-conducting metal in the passage having an outer surface bonded to but distinct from the roll body and an inner surface bonded to but distinct from the heating element, the metal having a melting point in excess of the operating temperature of the roll.

2. The calender roll defined in claim 1 wherein the roll is formed with a plurality of such passages each receiving a respective such electrical heating element and a respective mass of the heat-conducting metal.

3. The calender roll defined in claim 1 wherein the roll is formed with a single such passage receiving a plurality of such electrical heating elements and the mass of the heat-conducting metal.

4. The calender roll defined in claim 1 wherein the mass is a metallic alloy.

5. The calender roll defined in claim 1 wherein the mass has high thermal conductivity.

6. The calender roll defined in claim 1 wherein the element has an outer surface of a material and the roll is formed of a material having melting points above the melting point of the metal.

7. The calender roll defined in claim 1, further comprising at least one temperature sensor imbedded in the body between the element and the outer surface of the body.

8. The calender roll defined in claim 7 wherein the temperature sensor is closer to the outer surface of the body than to the electrical heating element.

9. The calender roll defined in claim 7 wherein the heating element is subdivided axially into a plurality of individually energizable portions and the roll is provided with one such sensor level with each such portion.

* * * * *